US007380780B2

(12) United States Patent
Sasaki et al.

(10) Patent No.: US 7,380,780 B2
(45) Date of Patent: Jun. 3, 2008

(54) SHEET SUPPLYING APPARATUS AND IMAGE FORMING SYSTEM

(75) Inventors: Ichiro Sasaki, Ibaraki (JP); Takahiro Watanabe, Chiba (JP); Keita Takahashi, Chiba (JP); Naoto Watanabe, Chiba (JP); Takuya Kawamura, Tokyo (JP); Masahiro Serizawa, Ibaraki (JP); Hitoshi Kato, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 10/960,091

(22) Filed: Oct. 8, 2004

(65) Prior Publication Data

US 2005/0082737 A1 Apr. 21, 2005

(30) Foreign Application Priority Data

Oct. 16, 2003 (JP) ..... 2003-356361

(51) Int. Cl.
*B65H 3/44* (2006.01)

(52) U.S. Cl. ..... 271/9.02; 271/9.04; 271/9.13

(58) Field of Classification Search ..... 271/9.01–9.12; 412/9; 399/391

See application file for complete search history.

(56) References Cited

U.S. PATENT DOCUMENTS 4,796,035 A 1/1989 Kawasaki et al. ..... 346/108
5,072,924 A * 12/1991 Sugiyama ..... 271/110
5,258,779 A * 11/1993 Serizawa et al. ..... 346/134
5,290,024 A 3/1994 Takahashi ..... 371/122
5,383,654 A * 1/1995 Iseda ..... 271/9.05
5,474,287 A 12/1995 Takahashi ..... 271/10.13
5,592,881 A * 1/1997 Rabjohns ..... 101/483
5,764,369 A * 6/1998 Farrell et al. ..... 358/296
5,909,591 A * 6/1999 Brooke ..... 710/9
5,909,872 A 6/1999 Takahashi ..... 271/116
6,137,968 A * 10/2000 Sunou et al. ..... 399/23

(Continued)

FOREIGN PATENT DOCUMENTS

JP 1-209235 8/1989

(Continued)

*Primary Examiner*—Patrick Mackey
*Assistant Examiner*—Jeremy R Severson
(74) *Attorney, Agent, or Firm*—Fitzpatrick, Cella, Harper & Scinto

(57) ABSTRACT

A sheet supplying apparatus having a plurality of sheet decks for supplying sheets connected in series, and provided with a controller for controlling the feeding of the sheets of each sheet deck, wherein each sheet deck has a sheet stacking portion for supporting the sheets thereon, a sheet conveying path for guiding the sheets from an upstream side to a downstream side, and a joining conveying path joining the sheet conveying path for guiding the sheets from the sheet stacking portion to the sheet conveying path, wherein the sheet decks are connected in such a manner that the respective sheet conveying paths are connected thereto, and the controller judges the position of the sheet deck for supplying a sheet preceding by one the sheet supplied in predetermined order when the sheets are supplied in order from each sheet deck and controls so as to pre-feed the sheet in the predetermined order to the vicinity of the upstream side of a joining point between the sheet conveying path in the sheet deck for supplying the preceding sheet and the joining conveying path when the judged sheet deck is disposed downstream of the sheet deck for supplying the sheet in the predetermined order.

14 Claims, 10 Drawing Sheets

U.S. PATENT DOCUMENTS 6,148,172 A * 11/2000 Kanda et al. ..... 399/391
6,161,829 A * 12/2000 Kusumi ..... 271/9.05
6,259,468 B1 * 7/2001 Higuchi ..... 347/262
6,293,536 B1 9/2001 Boehmer et al. ..... 271/9.11
6,311,039 B1 10/2001 Funamizu et al. ..... 399/394
6,322,069 B1 * 11/2001 Krucinski et al. ..... 271/265.02
6,325,585 B1 12/2001 Sasaki et al. ..... 412/11
6,343,197 B1 1/2002 Serizawa et al. ..... 399/82
6,397,035 B2 5/2002 Kataoka et al. ..... 399/388
6,533,263 B2 * 3/2003 Tamura ..... 271/10.01
6,651,980 B2 * 11/2003 Isemura et al. ..... 271/259
6,702,274 B1 * 3/2004 Otsuka ..... 271/10.01
6,782,236 B2 8/2004 Sasaki et al. ..... 399/401
6,804,473 B2 10/2004 Nakamura et al. ..... 399/16
6,804,474 B2 * 10/2004 Morita et al. ..... 399/23
6,806,972 B1 * 10/2004 Daddis et al. ..... 358/1.1
6,826,374 B2 * 11/2004 Kato et al. ..... 399/16
6,836,640 B2 * 12/2004 Isemura et al. ..... 399/388
6,978,992 B2 * 12/2005 Otsuka ..... 271/10.01
2003/0184010 A1 * 10/2003 Kato et al. ..... 271/207
2004/0190057 A1 * 9/2004 Takahashi et al. ..... 358/1.15
2004/0217538 A1 * 11/2004 Kawamura ..... 271/9.01
2005/0073082 A1 * 4/2005 Wakabayashi et al. ..... 270/37
2005/0082734 A1 * 4/2005 Goto et al. ..... 271/1
2005/0147487 A1 * 7/2005 Wakabayashi et al. ..... 412/9

FOREIGN PATENT DOCUMENTS

JP 2001-506212 5/2001
WO WO 98/17572 4/1998

* cited by examiner

FIG. 10

| PAGE ORDER | SHEET IDENTIFIER | SHEET DECK |
|---|---|---|
| 1 | SHEET A | 1200d |
| 2 | SHEET B | 1200b |
| 3 | SHEET C | 1200d |

SHEET SUPPLYING APPARATUS AND IMAGE FORMING SYSTEM

BACKGROUND OF THE INVENTION

1. Field of the Invention

The invention relates to a sheet supplying apparatus provided with a plurality of sheet decks stacking various sheets thereon and capable of supplying many kinds of sheets, and an image forming system provided with the sheet supplying apparatus and for forming images on the many kinds of sheets supplied from the sheet supplying apparatus, and providing the sheets in the form of bundle to a user.

2. Description of Related Art (First Example of the Conventional Art)

Fields related to digital copying machines and printing include a field called on-demand print, and in recent years, this field has been attracting attention. The on-demand print can meet many kinds and small lots of demands on demand from customers, and facilitates the alteration of contents, and is suited for the production of documents such as manuals and pamphlets for individuals. Also, the on-demand print facilitates the alteration of contents and can therefore greatly curtail the stock of printed documents or the like. Further, the on-demand print can accomplish the great shortening of the number of steps and time by data inputting to the completion of bookbinding being effected by in-line, the great shortening of the time limit of delivery and the curtailment of delivery cost based on the ease of data forwarding by customers and a digital circuit being connected together.

An image forming apparatus such as a digital copying machine which has realized such an on-demand print technique is improved in its quality of image to a level approximate to printed matter by the recent heightening of the quality of image, and has come to be used for the printing of pamphlets such as catalogs and manuals of products, or pamphlets such as distributed matter in offices or the like.

Image forming systems using an image forming apparatus such as a copying machine coping with the on-demand print include what has been proposed as a large-sized image forming system for executing, by a series of job operations, such post-treating processes as the Z fold process of receiving the supply of sheets from a sheet supplying apparatus of large capacity, and folding a sheet fed out from the image forming apparatus into a substantially Z-shape (for example, the folding process of folding A3 size into A4 size, and thereafter folding one portion of A4 size into a half), the inserter process of inserting a different kind of sheet between the sheets, the stapling process of stapling a bundle of sheets, the punching process of punching the bundle of sheets, and the bookbinding process, in order to cope with a variety of sheets.

The sheet supplying apparatus, as is disclosed in Japanese Patent Application Laid-Open No. 2001-506212, is formed by a plurality of sheet decks stacking different kinds of sheets thereon being connected in series (in tandem). A variety of sheets include sheets differing in size, thickness, material, etc.

(Second Example of the Conventional Art)

There is also such a system printer as described in Japanese Patent Application Laid-Open No. H01-209235. That is, there is also a system printer in which prior to the supply of sheets from a sheet tray which is the sheet stacking means of a sheet deck provided with a relatively long conveying path and connected, a sheet is preliminarily conveyed to just before a position which first joins another sheet conveying path to thereby keep the order of sheet conveyance to an image forming portion, and yet shorten the sheet conveying distance to the image forming portion, thereby improving productivity.

(Problems Peculiar to the First Example of the Conventional Art)

The image forming system in which the sheet decks of the sheet supplying apparatus of large capacity are connected in series (in tandem) shares a sheet conveying path from each sheet deck to the image forming apparatus, and therefore has suffered from the following problems.

For example, in the job of preparing a bundle of sheets having different kinds of sheet mixed in one and the same bundle of sheets, it sometimes happens that due to the changing of the kind of the sheet, the sheet deck for supplying the sheets is changed from a sheet deck nearest to the image forming apparatus to a sheet deck farthest from the image forming apparatus. In such case, if the sheets are supplied from the sheet deck to the image forming apparatus at ordinary sheet supply timing, the farthest sheet deck, which has a long sheet conveying path, supplies a sheet at an interval corresponding to the long conveying distance, with respect to a sheet supplied from the nearest sheet deck. This has led to the problem that the image forming timing of the image forming apparatus becomes late and the productivity of the image forming system is lowered.

In order to cope with this problem, there is conceivable the conveyance control of changing the sheet supply timing with the number of the connected sheet decks or the connection and disposition of the sheet decks taken into account, or accelerating the sheets in the sheet conveying path to thereby shorten the inter-sheet interval, but in this case, there may arise another problem that the conveyance control becomes complicated.

(Problem Peculiar to the Second Example of the Conventional Art)

The system printer according to the second example of the conventional art suffers from the problem that only one sheet deck can be connected thereto and the kinds of the sheets are limited.

SUMMARY OF THE INVENTION

It is an object of the present invention to provide a sheet supplying apparatus having sheet decks connected in series to an apparatus to be supplied with sheets, wherein no delay occurs to the supply of the sheets even if the sheets are supplied from any sheet deck to the apparatus to be supplied with sheets.

It is also an object of the present invention to provide a large-scale image forming system having a plurality of sheet decks connected in series to an image forming apparatus, wherein no delay occurs to the supply of sheets even if sheets are supplied from any sheet deck to the image forming apparatus.

In order to achieve the above objects, the sheet supplying apparatus of the present invention is a sheet supplying apparatus having a plurality of sheet decks for supplying sheets, each of the sheet decks has sheet stacking means for supporting the sheets thereon a sheet conveying path for guiding the sheets from an upstream side to a downstream side and a joining conveying path joining the sheet conveying path for guiding the sheets from the sheet stacking means to the sheet conveying path, wherein the sheet decks are connected in such a manner that the respective sheet conveying paths are connected thereto, and controlling means for controlling the feeding of the sheets by each sheet deck, wherein the controlling means judges the position of the sheet deck for supplying a preceding sheet prior to by one a sheet supplied in predetermined order when the sheets are supplied in order from each sheet deck, and controls so as to pre-feed the sheet to the vicinity of the upstream side of a joining point of the sheet conveying path in the sheet deck of the preceding sheet and the joining conveying path when the judged sheet deck is disposed downstream of the sheet deck for supplying the sheet in the predetermined order.

In order to achieve the above objects, the sheet supplying apparatus of the present invention is a sheet supplying apparatus having a plurality of sheet decks for supplying sheets, each of the sheet decks has sheet stacking means for supporting the sheets thereon a sheet conveying path for guiding the sheets from an upstream side to a downstream side sheet conveying means for conveying the sheets along the sheet conveying path sheet supplying means for feeding out the sheets from the sheet stacking means a joining conveying path joining the sheet conveying path for guiding the sheets from the sheet stacking means to the sheet conveying path, wherein the sheet deck are connected in such a manner that the respective sheet conveying paths are connected thereto;

sheet detecting means for detecting the sheets conveyed thereto on the sheet conveying path; and controlling means for controlling the feeding of the sheets by each sheet deck, the controlling means judges the position of the sheet deck for supplying a preceding sheet prior to by one a sheet supplied in predetermined order when the sheets are supplied in order from each sheet deck, and operatively controls the sheet conveying means of each sheet deck when the judged sheet deck is disposed downstream of the sheet deck for supplying the sheet to thereby pre-feed the sheet in the predetermined order to a position near the upstream side of a joining point of the sheet conveying path of the sheet deck for supplying the preceding sheet and the joining conveying path on the basis of the detection by the sheet detecting means of the judged sheet deck, and make it wait until the interval to the preceding sheet becomes a predetermined interval.

In order to achieve the above objects, the image forming system of the present invention is an image forming system provided with an image forming apparatus for forming an image on a sheet, a sheet supplying apparatus having a plurality of sheet decks, each of the sheet decks has sheet stacking means for supporting the sheets thereon a sheet conveying path for guiding the sheets from an upstream side to a downstream side a joining conveying path joining the sheet conveying path for guiding the sheets from the sheet stacking means to the sheet conveying path, wherein the sheet decks are connected in such a manner that the respective sheet conveying paths are connected thereto; and controlling means for controlling the feeding of the sheets of each sheet deck, the sheet supplying apparatus being connected to the image forming apparatus to thereby supply the sheets from the sheet decks to the image forming apparatus, the controlling means judges the position of the sheet deck for supplying a preceding sheet prior to by one the sheet supplied in predetermined order when the sheets are supplied in order from each sheet deck, and controls so as to pre-feed the sheet to the vicinity of the upstream side of the joining point of the sheet conveying path in the sheet deck for supplying the preceding sheet and the joining conveying path when the judged sheet deck is disposed downstream of the sheet deck for supplying the sheet in the predetermined order.

BRIEF DESCRIPTION OF THE DRAWINGS

FIG. 10 is a comparative table of the sheet decks and the supplied sheets.

DESCRIPTION OF THE PREFERRED EMBODIMENTS

An image forming system according to an embodiment of the present invention will hereinafter be described with reference to the drawings.

(Image Forming System)

Figure 1:
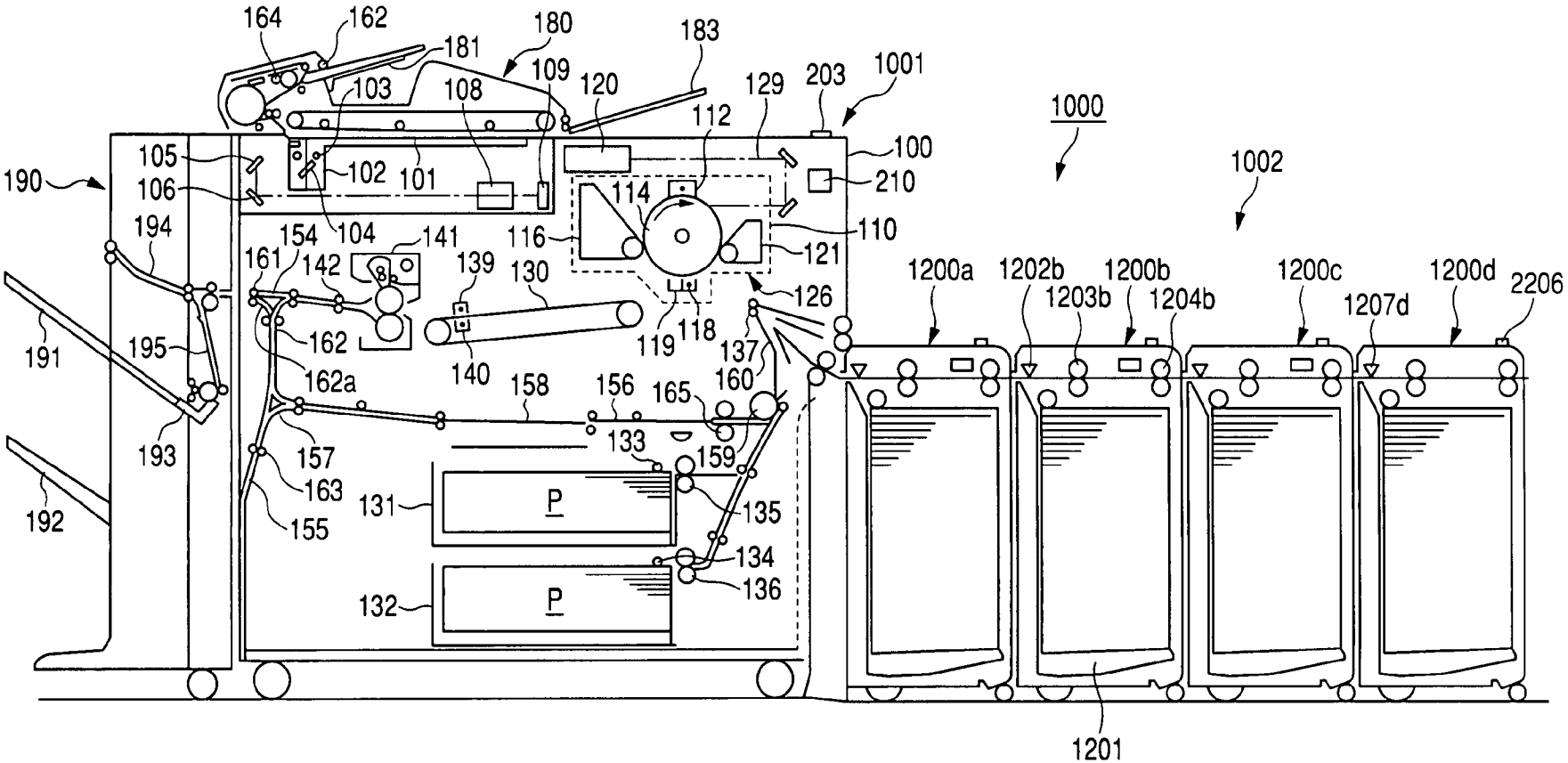
FIG. 1 is a cross-sectional view showing the construction of an image forming system according to an embodiment of the present invention.

FIG. 1 is a cross-sectional view showing the construction of the image forming system according to the embodiment of the present invention. The image forming system 1000 is comprised of an image forming apparatus 1001 which is an apparatus to be supplied with sheets and a sheet supplying apparatus 1002 connected thereto. The sheet supplying apparatus 1002 is comprised of four sheet decks 1200*a*, 1200*b*, 1200*c* and 1200*d* connected in series. The number of the sheet decks is not restricted to four, but a plurality of sheet decks can be connected. Also, when the sheet decks are to be described without the four sheet decks being specified, the reference numeral 1200 is used.

The image forming apparatus 1001 and the sheet supplying apparatus 1002 will hereinafter be described in the named order.

(Image Forming Apparatus)

In FIG. 1, the image forming apparatus 1001 is comprised of a main body 100, an automatic document feeder 180 provided in the upper portion of the main body 100, and a discharged sheet treating apparatus 190 provided by the side of the main body 100.

(Main Body of the Image Forming Apparatus)

The main body 100 of the image forming apparatus 1001 is provided with an original plate (platen glass plate) 101 as a document supporting stand in the upper portion thereof. A scanner 102 is comprised of an original illuminating lamp 103, a scanning mirror 104, etc. The image of a document placed on the original plate 101 is scanned by the scanner 102 controlled so as to be reciprocally moved in a predetermined direction (a horizontal direction in FIG. 1) by a motor, not shown, and reflected light from the document is transmitted through a lens 108 through the intermediary of the scanning mirrors 104, 105 and 106 and is imaged on an image sensor portion (CCD sensor) 109, whereby it is converted into an electrical signal.

An exposure controlling portion 120 is comprised of a laser output portion, a polygon scanner, etc., not shown, and applies a laser beam 129 to the photosensitive drum 110 of an image forming portion 126. The laser beam 129 is modulated on the basis of an image signal resulting from predetermined image processing which will be described later having been effected on an electrical signal obtained by photoelectrically converting the reflected light from the document outputted from the image sensor portion 109.

Around the photosensitive drum 110, there are provided a primary charging device 112, a developing device 121, a transfer charging device 118, a separation charging device 119, a cleaning apparatus 116 and a pre-exposure lamp 114 which, together with the photosensitive drum 110, constitute the image forming portion 126. The photosensitive drum 110 is adapted to be rotated in the direction of arrow by a motor, not shown, and is charged to desired potential by the primary charging device 112, whereafter the laser beam 129 from the exposure controlling portion 120 is applied to the photosensitive drum 110, whereby an electrostatic latent image is formed on the outer peripheral surface thereof. The electrostatic latent image formed on the photosensitive drum 110 is developed by the developing device 121 and is visualized as a toner image.

On the other hand, a sheet P supplied from an upper cassette 131 or a lower cassette 132 by a pickup roller 133 or 134 is fed into the main body 100 of the image forming apparatus 1001 by sheet supplying rollers 135 or 136, and passes through a sheet path 160, and thereafter is fed into between the photosensitive drum 110 and the transfer charging device 118 by registration rollers 137. There is also a sheet fed from the sheet supplying apparatus 1002 to the registration on the photosensitive drum 110 is transferred to these sheets P when they pass the outer periphery of the photosensitive drum 110. The photosensitive drum 120 after the toner image has been transferred to the sheet P has any residual toner thereon removed by the cleaning apparatus 116, and any residual charges are eliminated by the pre-exposure lamp 114.

The sheet after the transfer is separated from the image forming portion 126 by the separation charging device 119, and is conveyed away from the photosensitive drum 110 by a conveying belt 130. The toner image on the sheet is fixed on the sheet by the sheet being re-charged by ante-fixing charging devices 139, 140, and pressurized and heated in a fixing device 141. The sheet having had the toner image fixed thereon is discharged out of the main body 100 of the image forming apparatus 1001 by discharge rollers 142.

A sheet discharging flapper 154 is adapted to change over a sheet path on a sheet discharge side and a sheet path on a two-side recording side or a multiplex recording side. The sheet fed out from the discharge rollers 142 is conveyed to the sheet path on the two-side recording side or the multiplex recording side when the sheet discharging flapper 154 is above. In the case of the two-side recording, the sheet having had the toner image on a first side thereof fixed is fed out from the discharge rollers 142 and reversed through a reversing path 155, and is directed through a lower conveying path 158 to a sheet re-supplying tray 156. A multiplex flapper 157 is adapted to change over the sheet path on the two-side recording side and the sheet path on the multiplex recording side, and when leftwardly brought down, can guide the sheet directly to the lower conveying path 158 without the intermediary of the reversing path 155 to thereby effect multiplex recording on the sheet. A sheet supplying 159 is adapted to supply the sheet to the image forming portion 126 side through a sheet path 160.

Discharge rollers 161 are disposed near the sheet discharging flapper 154, and are adapted to discharge the sheet fed from the discharge rollers 142 out of the apparatus in a state in which the sheet discharging flapper 154 is changed over to a discharging side (is not above). As previously described, during two-side recording (two-side copying) and during multiplex recording (multiplex copying), the sheet discharging flapper 154 is upwardly inclined so that sheets having had the toner image thereon fixed may pass through the lower conveying path 158 and be stored in the sheet re-supplying tray 156. The sheets stored in the sheet re-supplying tray 156 are separated one by one from below by separating and conveying rollers 165 and are again directed to the registration rollers 137 through the sheet path 160.

When the sheet is to be discharged from the main body 100 with its front side and back side reversed, the sheet discharging flapper 154 is raised upwardly and the multiplex flapper 157 is rightwardly brought down. Thereupon, the sheet to be discharged is once fed to the reversing path 155 side and is conveyed to a second feeding roller 162*a* side by the reverse rotation of reversing rollers 163 at the timing where at the trailing edge of the sheet has passed first feeding rollers 162, and is discharged out of the apparatus by discharge rollers 161.

(Automatic Document Feeder of the Image Forming Apparatus)

The automatic document feeder (DF) 180 is provided in the upper portion of the main body 100 and is adapted to automatically feed a document into the main body 100. The automatic document feeder (DF) 180 separates a bundle of documents placed on a document placing stand 181 by a user one by one from the uppermost document by a sheet supplying roller 182, and conveys them onto the original plate 101 by a document sheet supplying roller 164. Thereafter, the document is scanned by the scanner 102. The thus scanned document is discharged onto a document discharging stand 183, or is returned to the document placing stand 181.

(Discharged Sheet Treating Apparatus of the Image Forming Apparatus)

A discharged sheet treating apparatus 190 is installed by the side of the main body 100, and is adapted to put in order and bind the sheets fed out from the main body 100. When the discharged sheet post-treating operation such as sorting and stapling are not set, the sheets pass through a conveying path 194 and are discharged onto a sheet discharging tray 191. On the other hand, when the discharged sheet post-treating operation is set, the sheets pass through a conveying path 195 and are discharged one by one onto and stacked on a treating tray 193 and are put in order. Then, the sheets in the image forming for the first copy are made into a bundle shape and bound (stapled), and are selectively discharged onto the sheet discharging tray 191 or a sheet discharging tray 192. When the discharged sheet post treating operation is set, basically the sheets are bundle-discharged onto the sheet discharging tray 192, but when the sheet discharging tray 192 is full of the sheets, the destination of discharge is changed over to the sheet discharging tray 191. The sheet discharging trays 191 and 192 have their upward and downward movement controlled by a motor, not shown, and before the start of the image forming operation, the sheet discharging tray 191 (or 192) which has become capable of stacking the sheets thereon is adapted to be moved up or down so as to come to the position of the treating tray 193.

(Controlling Portion of the Image Forming Apparatus)

Figure 2:
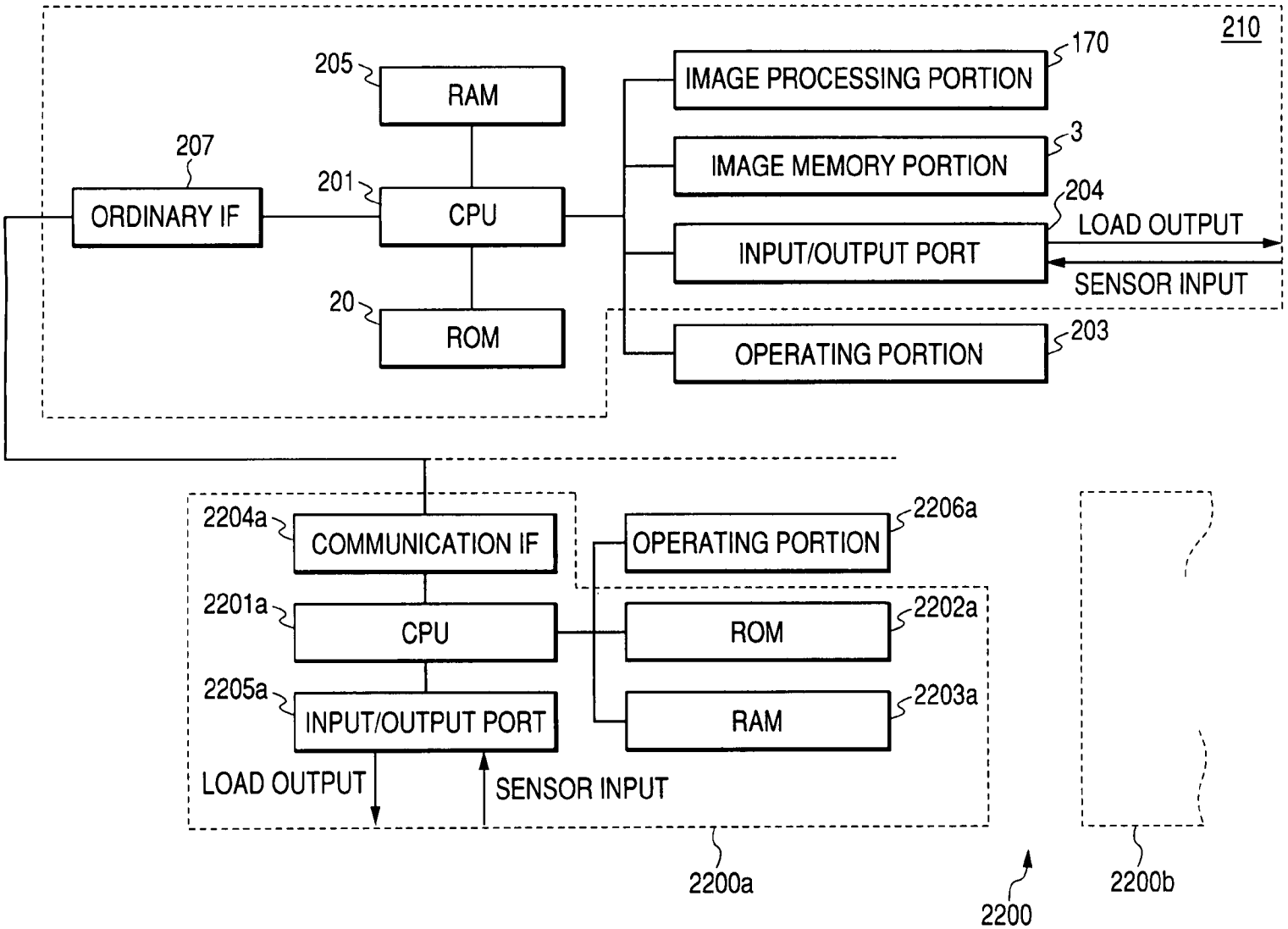
FIG. 2 is a block diagram showing the construction of each of the controlling portions of an image forming apparatus main body and a sheet supplying apparatus.

FIG. 2 is a block diagram showing the construction of the controlling portion 210 of the image forming apparatus 1001 and controlling portions 2200*a* to 2200*d* provided in respective sheet decks 1200. the description of the controlling portions of the sheet decks 1200*a* to 1200*d* and the description of the construction thereof will be made later.

In the controlling portion 210 of the image forming apparatus 1001, a CPU 201 for effecting basic control has connected thereto, by an address bus and a data bus, a ROM 206 having a control program written thereinto, a work RAM 205 for effecting processing, and an input output port 204. A part of the area of the RAM 205 is a backup RAM from which data is not erased even if a power supply is cut off. The input/output port 204 has connected thereto various load devices such as a motor and a clutch controlled by the CPU 201, and an input device to the CPU 201, such as a sensor for detecting the position of the sheet.

The CPU 201 is adapted to successively effect the control of an input and an output through the input output port 204 in accordance with the contents of the control program of the ROM 206 to thereby execute the image forming process. Also, an operating portion 203 is connected to the CPU 201. The CPU 201 is adapted to control the display means and key input means of the operating portion 203. When the user instructs the CPU 201 to change over the image forming operation mode and the display through the key input means, the CPU 201 is adapted to effect the display of the operating state of the image forming apparatus 1001 and the operating mode set by a key input, to the display means of the operating portion 203 (the details of this will be described later in connection with FIG. 6). Also, the CPU 201 has connected thereto an image processing portion 110 for processing a signal converted into an electrical signal by the image sensor portion 109 (see FIG. 1), and an image memory portion 3 for accumulating a processed image therein.

(Image Processing Portion and Image Memory Portion of the Image Forming Apparatus)

Reference is now had to describe the relation between the image processing portion 170 and the image memory portion 3, etc.

Figure 3:
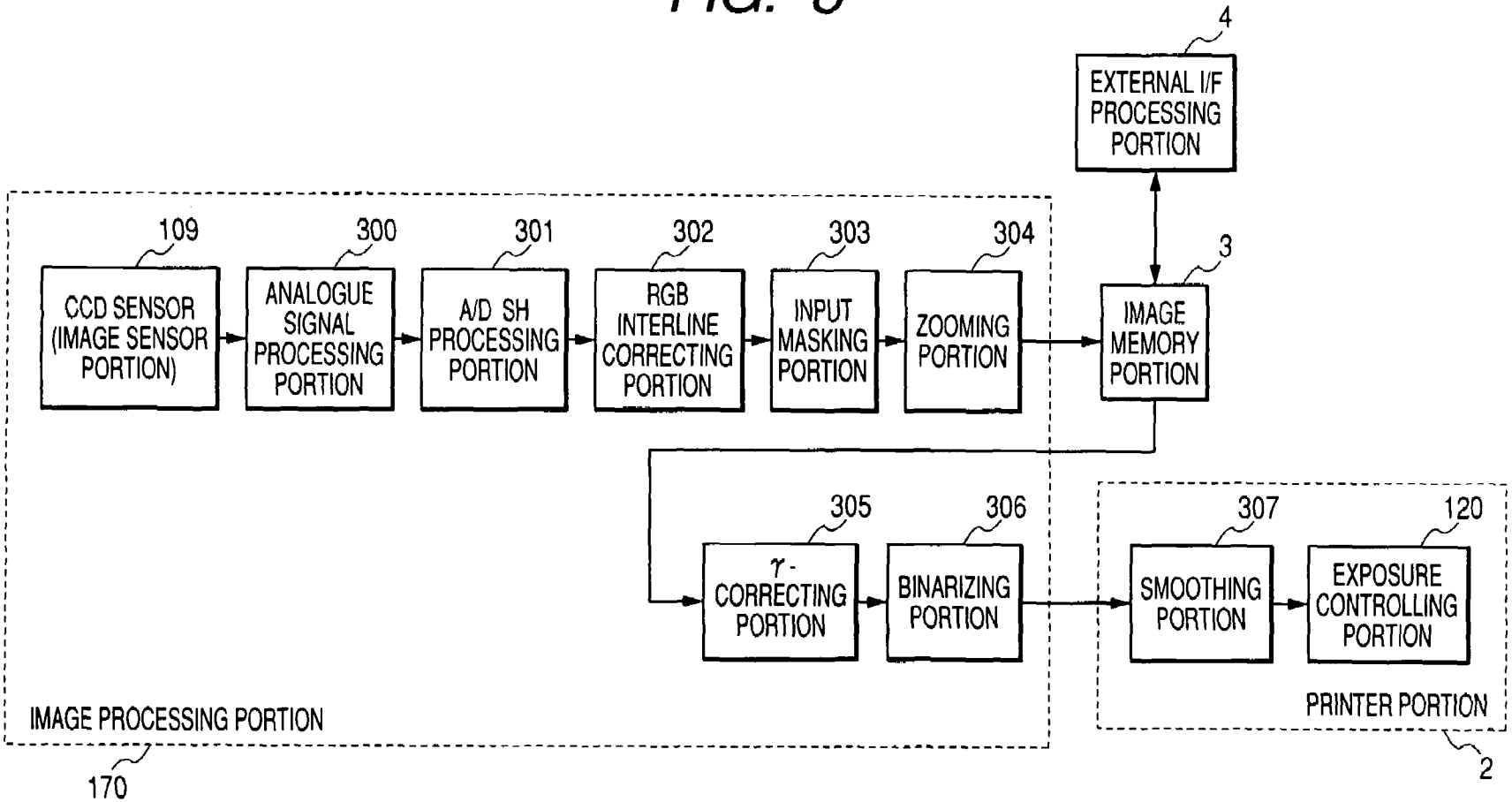
FIG. 3 is a block diagram showing the interval construction of an image processing portion.
Figure 4:
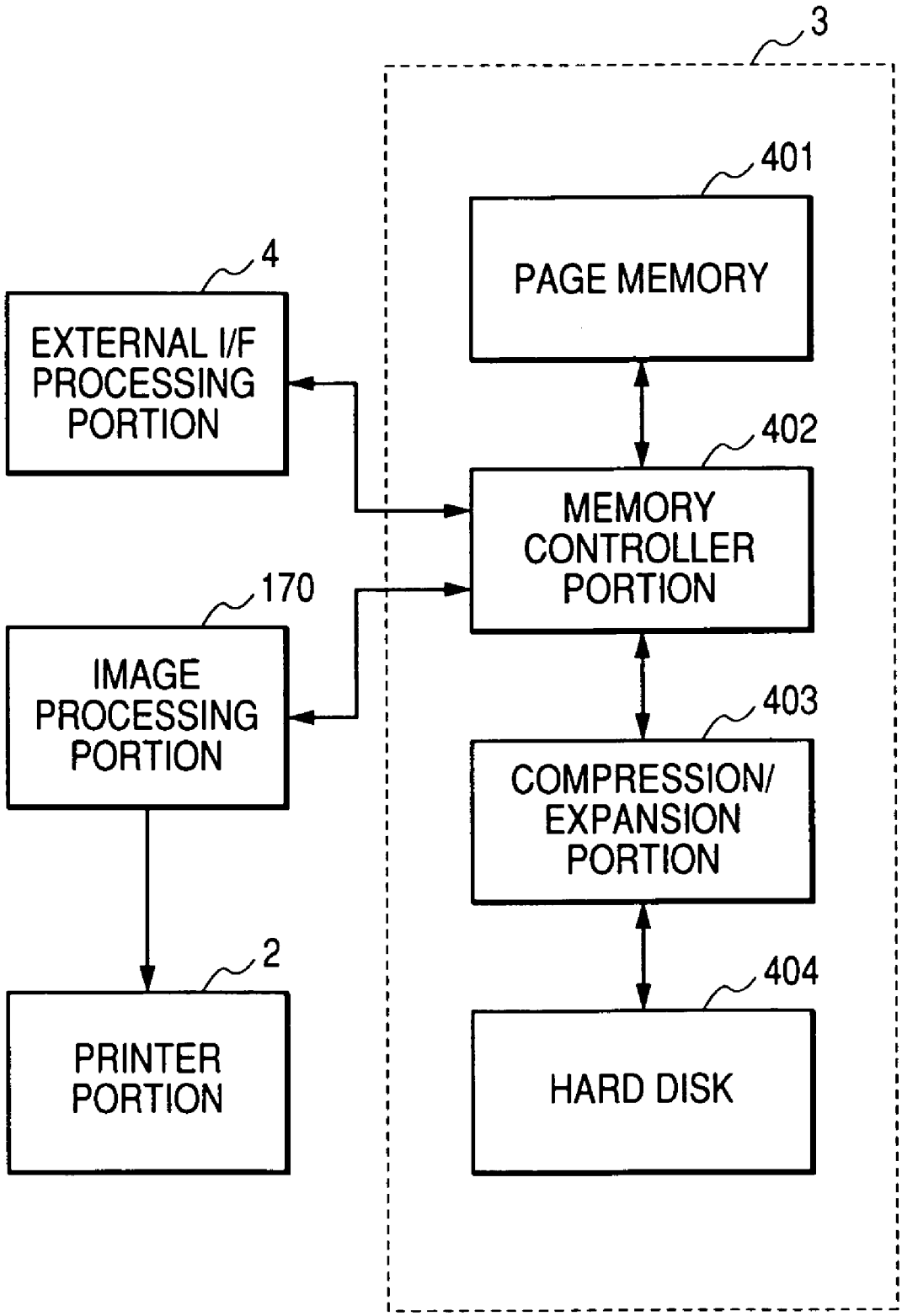
FIG. 4 is a block diagram showing the relation between an image memory portion and the image processing portion, etc.

FIG. 3 is a block diagram showing the internal construction of the image processing portion 170. FIG. 4 is a block diagram showing the relation between the image memory portion 3 and the image processing portion 170, etc.

Description will first be made of the flow of the processing when the image of the document scanned by the scanner 102 (see FIG. 1) is printed. The image of the document formed on the image sensor portion (CCD sensor) 109 through the lens 108 is converted into an analogue electrical signal by the image sensor portion 109 (See FIG. 3). The converted image information is inputted to an analogue signal processing portion 300 and is subjected to sampling, holding, the correction of a dark level, etc., whereafter it is analogue-digital-converted (A/D-converted) by an A/D SH processing portion 301, and shading correction is further effected on the digitized signal. In the shading correction, there are effected correction for the unevenness of each pixel the image sensor portion 109 has, and correction for the unevenness of the quantity of light due to the position based on the light distribution characteristic of the document illuminating lamp 103.

Then, the image information is subjected RGB interline correction in an RGB interline correcting portion 302. Lights inputted to the RGB light receiving portions of the image sensor portion 109 at a certain point of time deviate from one another on the document in accordance with the positional relation among the RGB light receiving portions and therefore, are synchronized here among RGB signals.

Thereafter, the light is subjected to a input masking process in an input masking portion 303 and an RGB value remaining outputted from the image sensor portion 109 in which conversion from luminance data to density data is effected is subject to the influence of a color filter mounted on the image sensor portion 109 and therefore has the influence corrected and is converted into a genuine RGB value.

Thereafter, the image is zooming-processed at a desired zooming rate in a zooming portion 304. The zoomed image data is sent to the image memory portion 3 and the image is accumulated therein. The image data of a computer is also inputted from an external I/F processing portion 4 to the image memory portion 3.

When the accumulated image is to be printed, the image data is sent from the image memory portion 3 to a γ correcting portion 305. In the γ correcting portion 305, in order to provide an output conforming to a density value set by the operating portion 203 (see FIG. 2), the conversion of density data corresponding to desired output density is effected from the original density data on the basis of a look-up table (LUT) taking the characteristic of the printer into account.

Thereafter, the density data is sent to a binarizing portion 306. In the binarizing portion 306, the binarization of the multi-value density data is effected. In the case of the multi-value density data, e.g., density data of 8 bits, the density value assumes any value between "0" to "255," but by being binarized, the density value becomes only two, e.g., "0" or "255." That is, in order to represent the density of a certain pixel, data of 8 bits has been necessary, whereas by being binarized, a data amount of 1 bit becomes enough. Thereby, a memory capacity for storing the image data is reduced. On the other hand, however, the harmony of the image changes from the original 256 gradations to 2 gradations and therefore, in image data having a lot of halftone like a photographic image, it is said that the quality of image thereof is remarkably deteriorated by the binarization of the image.

So, the expression of quasi halftone by binarized data becomes important. Here, an error diffusing method is used as a technique of effecting halftone expression in a quasi manner by binary data. In this method, the density of a certain image, if greater, than a certain threshold value, is binarized as the density data of "255," and if equal to or less than a certain threshold value, is binarized as the density data of "0," and the difference between the actual density data and the binarized density data is found as an error signal and is distributed to peripheral pixels. The distribution of the error is effected by multiplying the error caused by binarization by a weight factor on a predetermined matrix, and adding the result to the peripheral pixels. Thereby, the density average value in the entire image is preserved, and the halftone can be expressed by a binary in a quasi manner.

This binarized density data is sent to a smoothing portion 307 in a printer portion 2. In the smoothing portion 307, the complementing of the data is effected so that the end portion of the line of this binarized image may become smooth, and the complemented image data is outputted to the exposure controlling portion 120. The exposure controlling portion, as previously described, forms the electrostatic latent image of the image data on the photosensitive drum 110.

Description will now be made of the flow of the processing when the scanned image is forwarded via a network.

Up to the accumulation of the density data in the image memory portion 3 which is the first half portion, the flow is the same as the flow of the processing during the aforedescribed printing, and thereafter, the image data is sent from the image memory portion 3 to the external I/F processing portion 4, and is forwarded from the external I/F processing portion 4 to a desired computer via the network.

FIG. 4 is a block diagram showing the internal construction of the image memory portion 3 and a peripheral apparatus.

The image memory portion 3 is comprised of a page memory 401, a memory controller portion 402, a compression/expansion portion 403 and a hard disk 404.

The image data sent from the external I/F processing portion 4 and the image processing portion 170 to the image memory portion 3 is written into the page memory 401 by the memory controller portion 402, and thereafter is sent to the printer portion 2 through the image processing portion 170 or is accumulated in the hard disk 404. The image data, when accumulated in the hard disk 404, is data-compressed in the compression/expansion portion 403, and is written as compressed data into the hard disk 404.

The memory controller portion 402 is also adapted to effect the reading out of the image data stored in the hard disk 404 to the page memory 401. At that time, the compressed data read out from the hard disk 404 is expanded through the compression/expansion portion 403, and the image data restored to the original state is written into the page memory 401. Also, the memory controller portion 402 effects the production of a DRAM refresh signal to be sent to the page memory 401, the mediation of the access from the external I/F processing portion 4, the image processing portion 170 and the hard disk 404 to the page memory 401, and the determination and control of the writing address into the page memory 401 the reading-out address and the reading-out direction from the page memory 401 in accordance with the instructions of the CPU 201 (see FIG. 2).

By these processes, the CPU 201 can control the function of arranging a plurality of document images and effecting the layout thereof, and thereafter outputting them to the printer portion 2 through the image processing portion 170, the function of cutting out only a portion of the images and outputting it, and the function of effecting the rotation of the images.

Also, for example, regarding a sorting mode, the CPU repeats and executes the control of reading out the images in the order in which they have been recorded in the image memory portion 3 for a certain bundle of documents a plurality of times. By executing such control, even in a finisher having only a few bins like the discharged sheet treating apparatus 190 in the present embodiment, the CPU can perform the same role as that of a sorter having a number of bins.

(External I/F Processing Portion and Peripheral Apparatus of the Image Forming Apparatus)

Figure 5:
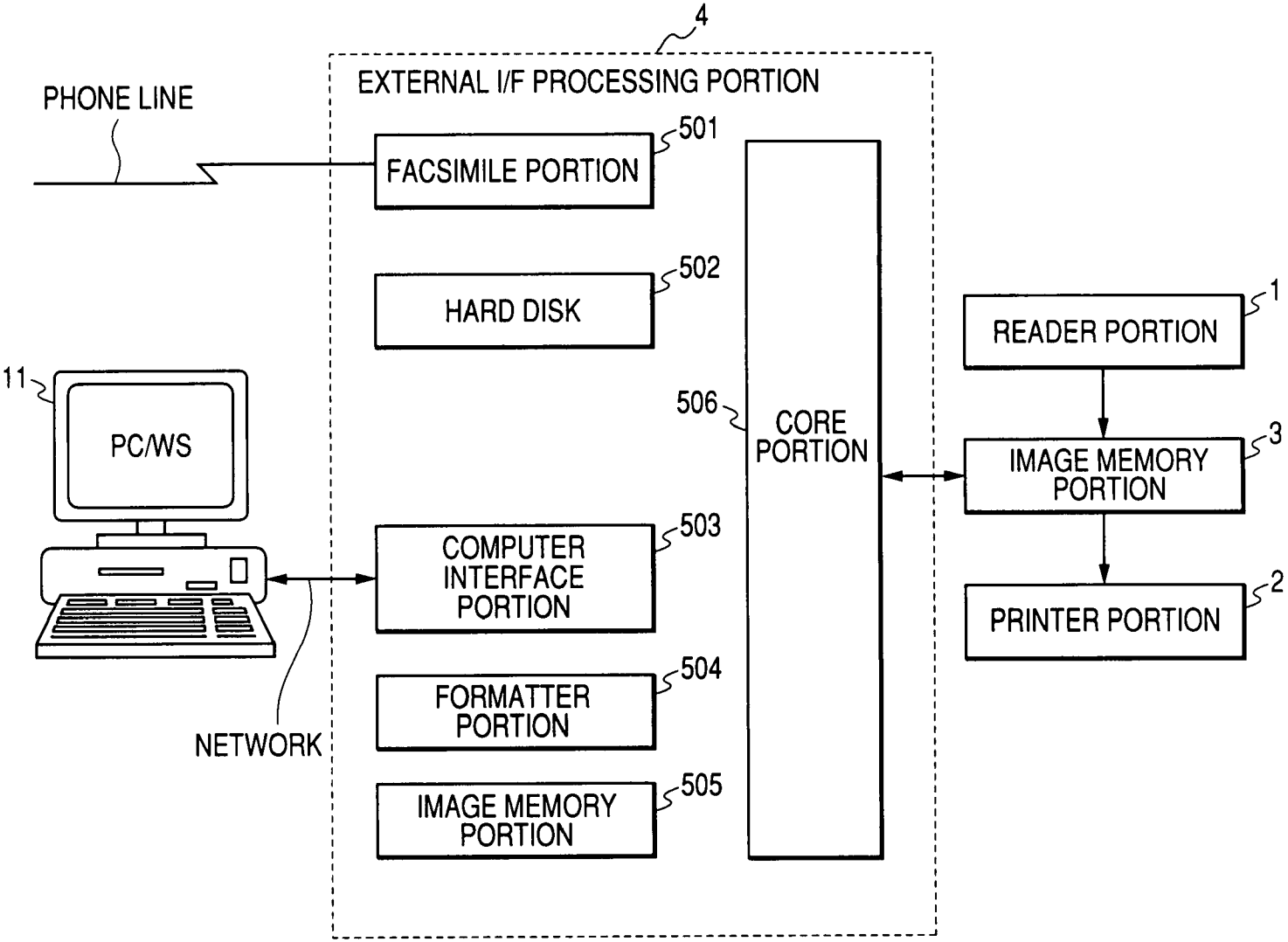
FIG. 5 is a block diagram showing the internal structure of an external I/F processing portion and the relation between the external I/F processing portion and a peripheral apparatus.

FIG. 5 is a block diagram showing the internal structure of the external I/F processing portion 4 and the relation between the external I/F processing portion 4 and a peripheral apparatus. The external I/F processing portion 4 introduces the image data from a reader portion 1 through the image memory portion 3, and sends the image memory portion 3, and sends the image data to an external computer or an external facsimile apparatus through the network or a phone line. Also, the external I/F processing portion 4 outputs the image data sent from the external computer or facsimile apparatus through the network on the phone line to the printer portion 2 through the image memory portion 3 (and the image processing portion 170). The printer portion 2 effects image forming on the basis of the image data.

The external I/F processing portion 4 is comprised of a core portion 506, a facsimile portion 501, a hard disk 502 for preserving the communication image data of the facsimile portion 501 therein, a computer interface portion 503 connected to the external computer 11, a formatter portion 504 and an image memory portion 505.

The facsimile portion 501 is connected to a public line through a modem (not shown), and effects the reception of facsimile communication data from the public line, and the transmission of the facsimile communication data to the public line. In the facsimile portion 501, the facsimile function of effecting FAX communication at a designated time, or transmitting the image data in accordance with an inquiry by a designated password from a partner is realized by the utilization of an image for FAX preserved in the hard disk 502.

Thereby, after an image has been once sent to from the reader portion 1 the facsimile portion 501 through the image memory portion 3 and the image has been preserved in the hard disk 502 for FAX, facsimile transmission can be effected without the reader portion 1 and the image memory portion 3 being used for the facsimile function.

The computer interface portion 503 is an interface portion for effecting data communication with the external computer 11, and has a local area network (LAN), a serial I/F, a SCSI-I/T, a Centro I/F for the data inputting of the printer, etc. The external I/F processing portion 4 effects the notification of the states of the printer portion 2 and the reader portion 1 to the external computer 11 through the computer interface portion 503. Or the external I/F processing portion 4 forwards an image read by the reader portion 1 to the external computer 11 through the computer interface portion 503 on the basis of instructions from the external computer 11.

Also, the computer interface portion 503 receives print image data from the external computer 11. At that time, the print image data notified from the external computer 11 is described in a printer code for exclusive use and therefore, in the formatter portion 504, the notified data code is converted into raster image data which can effect image forming in the printer portion 2. The converted raster image data is evolved into the image memory portion 505 by the formatter portion 504. On the other hand, when the image data is to be transmitted to the external computer 11 through the computer interface portion 503, the formatter 504 effects, in the image memory portion 404, density conversion and conversion into an image format recognizable by the external computer 11 on the print image data sent from the image memory portion 3.

The image memory portion 505, besides being thus used as a memory for evolving the raster image data of the formatter portion 504, is also used when the image data from the reader portion 1 is sent to the external computer 11 (network scanner function). That is, the external I/F processing portion 4, when the image from the reader portion 1 is to be sent to the external computer 11 via the computer interface portion 503, once evolves the image data sent from the image memory portion 3 into the image memory portion 505, and converts it into the form of data to be sent to the external computer 11, and thereafter delivers it from the computer interface portion 503 to the external computer 11.

The core portion 506 controls the forwarding of the data mutually effected among the facsimile portion 501, the computer interface portion 503, the formatter portion 504, the image memory portion 505 and the image memory portion 3. Thereby, even if a plurality of image output portions are connected to the external I/F processing portion 4 and even if the number of the image forwarding paths to the image memory portion 3 is one, the external I/F processing portion 4 can effect exclusive control and control of the degree of priority under the custody of the core portion 506 and can effect image outputting appropriately.

(Operating Portion of the Image Forming Apparatus)

Figure 6:
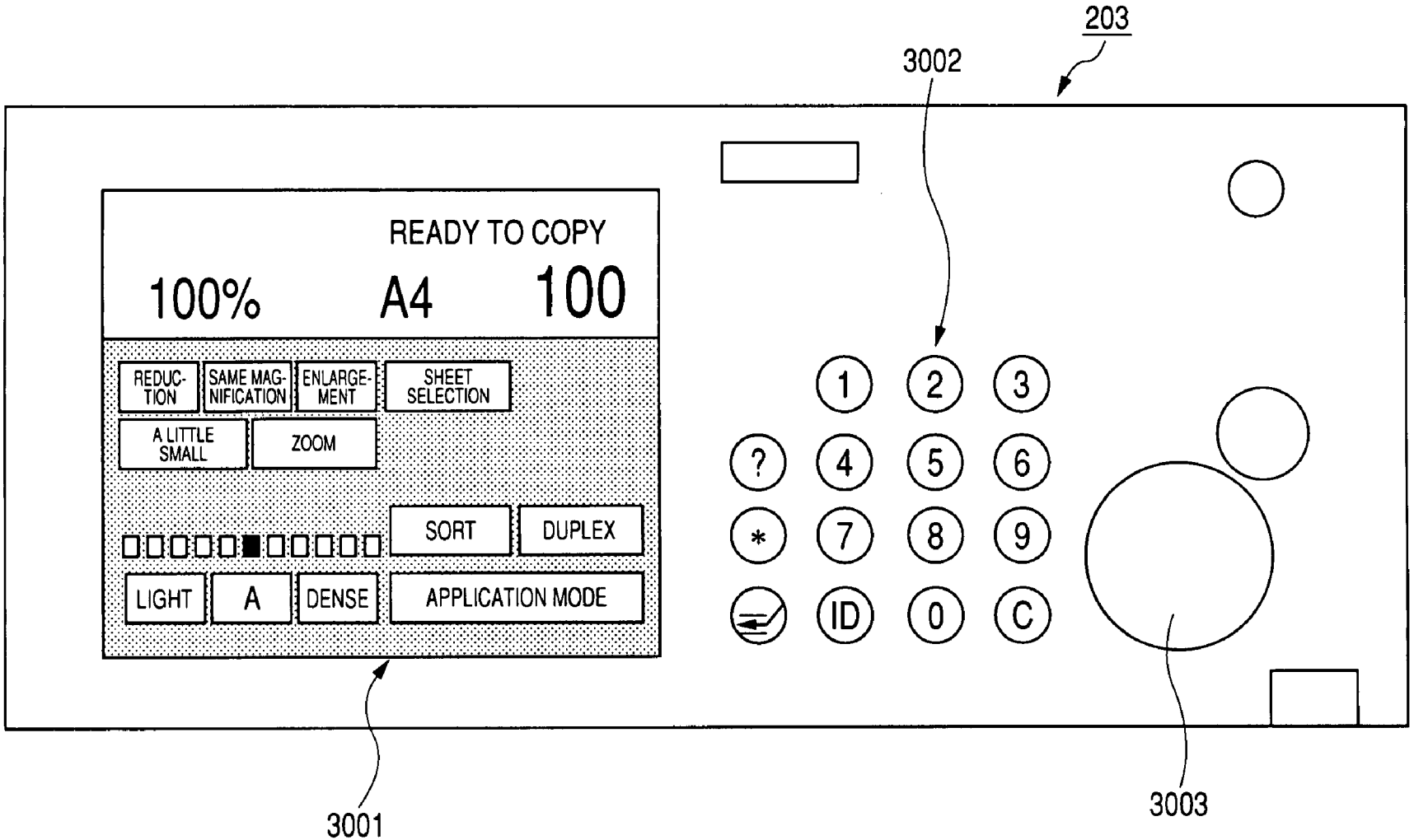
FIG. 6 is a plan view of the operating portion of an image forming apparatus.

FIG. 6 is a plan view of the operating portion 203 of the image forming apparatus. In FIG. 6, a display portion 3001 is adapted to display various messages such as the operating state of the apparatus and work instructions to the user, the working procedure, etc. The surface of the display portion 3001 is constituted by a touch panel, and is adapted to work as a selection key by being touched. Ten keys 3002, when depressed, are adapted to cause the image forming system 1000 to start the copying operation.

(Sheet Supplying Apparatus)

(Structure of the Sheet Supplying Apparatus)

The sheet supplying apparatus will now be described with reference to FIGS. 1 and 7.

The sheet supplying apparatus 1002 is connected to the main body 100 of the image forming apparatus 1001. The sheet supplying apparatus 1002 is constituted by four sheet decks 1200 (1200*a* to 1200*d*) of large capacity connected in series. As different sheets, there are the difference in sheet size, the difference in the material of the sheets, the difference in the thickness of the sheets, the difference as to whether the sheets are colored or not, etc. In the following description, the sheet decks 1200*a*, 1200*b*, 1200*c* and 1200*d* on the downstream side are referred to as the first, second, third and fourth sheet decks in the named order.

The sheet decks 1200*a* to 1200*d* of the sheet supplying apparatus 1002 are provided with lifters 1201*a* to 1201*d* which are sheet stacking means for stacking the sheets thereon and lifting them, sheet supplying rollers 1202*a* to 1202*d* which are sheet supplying means for receiving the uppermost ones of the sheets lifted by the lifters and feeding out those sheets, sheet conveying paths 1205*a* to 1205*d* which are sheet conveying paths for guiding the sheets, joining paths 1206*a* to 1206*d* which are joining conveying paths for guiding the sheets fed out by the sheet supplying rollers to the sheet conveying paths, conveying rollers 1203*a* to 1203*d* and 1204*a* to 1204*d* which are sheet conveying means for conveying the sheets to the downstream side, sheet detecting sensors 1207*a* to 1207*d* which are sheet detecting means for detecting the passage of the sheets, sheet detecting sensors 1209*a* to 1209*d* for detecting that the sheets have been fed out from the sheet decks, remaining amount detecting sensors, not shown, for detecting the sheet remaining amounts, etc.

The sheet detecting sensors 1207*a* to 1207*d* are disposed on the upstream side, preferably near the upstream side, of the joining points 1208*a* to 1208*d* between the joining paths 1206*a* to 1206*d* and the sheet conveying paths 1205*a* to 1205*d*. The sheet detecting sensors 1209*a* to 1209*d* are disposed near the joining points 1208*a* to 1208*d*, and are adapted to detect that the sheets have begun to be fed out from the joining points, and that the sheets have been fed out.

The second sheet deck 1200*b* to the fourth sheet deck 1200*d* are adapted to feed out the sheets by the sheet supplying rollers 1202*b* to 1202*d*, and supply them to the image forming apparatus main body 100 by the guide by the joining paths 1206*b* to 1206*d* and the sheet conveying paths 1205*a* to 1205*c*, and the conveyance by the conveying rollers 1203*a* to 1203*c* and 1204*a* to 1204*c*.

The sheets in the first sheet deck 1200*a* disposed on the most downstream side are supplied to the image forming apparatus main body 100 by the feeding-out by the sheet supplying roller 1202*a* and the guide by the joining path 1206*a*. Also, the sheet conveying path 1205*d* and conveying rollers 1203*d* and 1204*d* of the fourth sheet deck 1200*d* disposed on the most upstream side are used when a sheet deck is further connected on the upstream side.

Accordingly, in the sheet supplying apparatus 1002 having a plurality of sheet decks connected together, the sheets picked up by the sheet deck on the upstream side are adapted to be successively conveyed from there on the sheet conveying paths of the sheet decks on the downstream side and be finally supplied to the image forming apparatus main body. The conveying rollers of this sheet conveying path are adapted to continue the conveying operation even if the user opens the sheet decks to supply the sheets to the sheet decks information such as 1200. Also, design is made such that the sizes and materials of the sheets stored in the sheet decks can be set by the operating portions 2206*a* to 2206*d* (see FIGS. 2 and 7) which will be described later. Design may be made such that the information regarding the sheets can also be inputted from the operating portion 203 (see FIGS. 2 and 6) of the image forming apparatus 1001. The number of the sheet decks connected is not limited, and further, the order of the connection can also be changed.

(Controlling Portion of the Sheet Supplying Apparatus)

The controlling portion will now be described with reference to FIGS. 2 and 7. The sheet decks 1200*a* to 1200*d* are provided with controlling portions 2200*a* to 2200*d*. The controlling portion 2200*a* provided in the first sheet deck 1200*a* will be described and the showing and description of the other controlling portions 2200*b* to 2200*d* will be omitted. Therefore, reference characters to be given to constituent elements in the respective controlling portions are given in accordance with the alphabet characters of the sheet decks 1200*a* to 1200*d*.

A ROM 2202*a* having a control program written thereinto, a work RAM 2203*a* for carrying out processing, and an input/output port 2205*a* are connected to a CPU 2201*a* for effecting basic control, by an address bus and a data bus. The area of a part of the RAM 2203*b* is a backup RAM from which data is not erased even if a power supply is cut off. The input/output port 2205*a* has connected thereto various load devices such as a motor and a clutch controlled by the CPU 2201*a*, and an input device to the CPU 2201*a*, such as a sensor for detecting the position of the sheet.

Also, the CPU 2201*a* has an operating portion 2206*a* connected thereto. The CPU 2201*a* is adapted to control the display means and key input means of the operating portion

2206*a*. When the user instructs the CPU 2201*a* through the key input means to operate the sheet decks 1200*a* to 1200*d*, and set the kind, size, etc., of the sheets, the CPU 2201*a* is adapted to cause the display means of the operating portion 2206 to display the kind and size of the sheets set by a key input.

The CPU 2201*a* is adapted to successively effect the control of an input and an output through the input/output port 2205*a* in accordance with the contents of the control program of the ROM 2202*a* to thereby execute the sheet separating and conveying processes correspondingly to a command from the image forming apparatus 1001.

The CPU 201 (see FIG. 2) of the image forming apparatus 1001 and the CPU 2201*a* of the sheet deck 1200*a* are adapted to effect the exchanges of information with the image forming apparatus 1001 and the sheet deck 1200*a* by communication Ifs 207 and 2204*a*. The controlling portion 210 is a main controlling portion, and the controlling portions 2200*a* to 2200*d* are sub-controlling portions. These controlling portions 210 and 2200*a* to 2200*a* together constitute controlling means.

Of the constituent elements of the controlling portion 210, the portion for controlling the sheet supplying apparatus 1002 may be provided in any one of he sheet decks 1200. Preferably, it may be provided in the sheet deck 1200*a* on the most downstream side.

The controlling portions 2200*a* to 2200*d* of the respective sheet decks may be provided in the respective sheet decks, or may be provided any one sheet deck. When the controlling portions are provided in any one sheet deck, it is preferable that they be provided in the first sheet deck 1200*a* with the changing of the number of the connected sheet decks taken into account.

(Description of the Sheet Supplying Operation of the Sheet Supplying Apparatus)

The sheet supplying operation of the sheet supplying apparatus will now be described with reference to FIGS. 1, 2 and 7 to 10.

(Description of the Operation when the Sheets are Supplied from a Sheet Deck)

The user inputs the kind and number of sheets on which images are formed to the operating portion 203 of the image forming apparatus main body 100.

The CPU 201 of the controlling portion 210 of the image forming apparatus main body 100 transmits the kind information of the sheets inputted by the user to the controlling portions 2200*a* to 2200*d* of the sheet decks 1200*a* to 1200*d*. Assuming that sheets coinciding the sheet information are stacked, for example, on the fourth sheet deck 1200*d* on the most upstream side (the rightest side in FIG. 7), the CPU 2201*d* of the controlling portion 2200*d* of the fourth sheet deck 1200*d* starts sheet supply control and operates the sheet feeding roller 1202*d*, etc. The sheet is fed out from the fourth sheet deck 1200*d* via the joining path 1206*d*.

The sheet, however, must pass through the sheet conveying paths 1205*c*, 1205*b* and 1205*a* of the third sheet deck 1200*c*, the second sheet deck 1200*b* and the first sheet deck 1200*a*, respectively, on the downstream side. So, the controlling portion 2200*d* of the fourth sheet deck 1200*d* instructs the controlling portions 2200*c*, 2200*b* and 2200*a* of the sheet decks 1200*c*, 1200*b* and 1200*a*, respectively, on the downstream side to rotate the conveying rollers 1204*c*, 1203*c*, 1204*b*, 1203*b*, 1204*a* and 1203*a*. As the result, the sheets designated by the user are prevented from being double fed and only a designated number of sheets are fed to the image forming apparatus main body 100.

When the sheets are to be supplied from the first sheet deck 1200*a* on the most downstream side, of course it is not necessary to rotate the conveying rollers of the sheet decks 1200*d*, 1200*c* and 1200*b* on the upstream side.

(Description of the Pre-feeding Operation when the Sheets are Supplied from Two Sheet Decks)

The description of the pre-feeding operation will now be made with reference to FIGS. 1, 2, 7 and 8. The user inputs the information of two kinds of sheets on which images are formed to the operating portion 203 of the image forming apparatus main body 100 in the order of image forming. For example, it is to be understood that input information is repeated in the order of B-sheet and A-sheet to thereby form images on the sheets.

The CPU 201 of the controlling portion 210 of the image forming apparatus main body 100 instructs the controlling portion 2200*b* of the second sheet deck 1200*b* stacking the B-sheets thereon and the controlling portion 1200*d* of the fourth sheet deck 1200*d* stacking the A-sheets thereon to supply the sheets. The second sheet deck 1200*b* and the fourth sheet deck 1200*d* become ready to supply the sheets (step 101). The step will hereinafter be abbreviated as "S."

In this case, only the information for supplying the sheets in the order of the B-sheet and the A-sheet is sent to the respective controlling portions and, therefore, the fourth sheet deck 1200*d* has obtained only the information that the A-sheets can be sent after the B-sheets. So, the controlling portion 2200*d* of the fourth sheet deck 1200*d* inquires the controlling portions 2200*a* to 2200*c* of the remaining three sheet decks 1200*a* to 1200*c* about which sheet deck is the sheet deck on which the preceding B-sheets are stacked. In reply to this inquiry, the controlling portion 2200*b* of the second sheet deck 1200*b* notifies the controlling portion 2200*d* of the fourth sheet deck 1200*d* that the B-sheets are stacked on the second sheet deck 1200*b*. Thereby, the controlling portion 2200*d* of the fourth sheet deck 1200*d* can know that the B-sheets are stacked on the second sheet deck 1200*b*.

Now, the B-sheets in the second sheet deck 1200*b* on the downstream side are supplied earlier than the A-sheets in the fourth deck 1200*d* on the upstream side and therefore, the sheet conveying distance of the fourth sheet deck 1200*d* is longer than the sheet conveying distance of the second sheet deck 1200*b*, and when the fourth sheet deck 1200*d* on the upstream side is started and feeds out the succeeding A-sheet after the feeding-out of the preceding B-sheet from the second sheet deck 1200*b* on the downstream side, the interval between the preceding B-sheet on the downstream side and the succeeding A-sheet on the upstream side widens, and the supply of the A-sheet to the image forming apparatus main body 100 is delayed.

So, if by the aforedescribed operation, the fourth sheet deck 1200*d* which has known that the B-sheet is supplied from the second sheet deck 1200*b* conveyance-controls the A-sheet to the vicinity of the joining point 1208*b* of the second sheet deck 1200*b* while the B-sheet is fed out from the second sheet deck 1200*b* on the downstream side, and causes it to wait, the interval of the A-sheet relative to the B-sheet can be made into a predetermined interval to thereby supply the A-sheet to the image forming apparatus main body 100.

Accordingly, the controlling portion 2200*d* of the fourth sheet deck 1200, when it knows by the aforedescribed operation that the B-sheets are supplied from the second sheet deck 1200*b*, starts the supply of the A-sheets (S103) and also, instructs the controlling portions 2200*c* and 2200*b* on the downstream side to rotate the conveying rollers 1203*c*, 1203*b*, 1204*c* and 1204*b*. Thereby, during the time when the B-sheets on the downstream side are being fed out from the second sheet deck 1200*b*, the A-sheet on the upstream side arrives at the sheet detecting sensor 1207*b* disposed near the upstream side of the joining point 1208*b* in the second sheet deck 1200*b* (S105) and is detected.

When at this time, the B-sheet is being fed out from the second sheet deck 1200*b*, the A-sheet is detected at the position of the sheet detecting sensor 1207*b* of the second sheet deck 1200*b* and stands by (S109). That is, the A-sheet has been pre-fed. After it is detected by the sheet detecting sensor 1209*b* that the B-sheet has passed the joining point 1208*b* in the second sheet deck 1200*b* and has been completely fed out from the second sheet deck 1200*b* (S111), when the interval between the B-sheet and the A-sheet becomes a predetermined interval (S113), the conveyance of the A-sheet is resumed (S115).

On the other hand, in S107, even immediately after the B-sheet is fed out from the second sheet deck 1200*b*, the A-sheet stops and waits at the position of the sheet detecting sensor 1207*b* of the second sheet deck (S119). That is, the A-sheet has been pre-fed. Then, when the interval between the B-sheet and the A-sheet becomes a predetermined interval (S113), the conveyance of the A-sheet is resumed (S115).

When a predetermined number of B-sheets and A-sheets have not been fed (S117), subsequently to the first A-sheet, the second A-sheet is fed out from the fourth sheet deck 1200*d*, and is pre-fed. Thereafter, in the same manner as described above, the conveyance of the B-sheets and the A-sheets is effected. When a predetermined number of B-sheets and A-sheets are fed, the sheet supplying operation of the sheet supplying apparatus 1002 is stopped.

The feed timing from the fourth sheet deck 1200*d* is set so that the A-sheet may be conveyed to the image forming apparatus with a predetermined interval kept relative to the B-sheet. However, with the unevenness of the sheet conveying speed of the rollers and a change or the like in the conveying speed due to the long-term use taken into account, design is made such that the A-sheet is fed out from the fourth sheet deck at the timing whereat the A-sheet arrives at the sheet detecting sensor 1209*b* while the B-sheet is fed out from the second sheet deck 1200*b*. Accordingly, as described with regard to S107 and S119, there is also a case where after the B-sheet has been fed out from the second sheet deck 1200*b*, the A-sheet arrives at the sheet detecting sensor 1209*b*, and is re-conveyed at a predetermined interval.

The predetermined interval refers to an interval at which in the image forming apparatus, an image can be efficiently and accurately formed on a sheet, or an interval at which in the sheet supplying apparatus 1002, a sheet can be conveyed efficiently.

Also, each sheet deck in the above-described embodiment has one of the lifters 1201*a* to 1201*d*, but in some cases it is provided with multiple stages of lifters. When in such a sheet deck, sheets are to be fed out from the lowermost stage, there is the possibility that the start of the feeding-out of the sheet from the sheet deck is delayed. So, it is preferable that the sheet deck provided with multiple stages of lifters be designed such that when other sheet is passing through this sheet deck, the sheet in this sheet deck is conveyed in advance to the joining point or to the vicinity thereof.

As described above, the sheet supplying apparatus 1002 of the present embodiment conveys sheets to the image forming apparatus main body by repeating the order of B-sheet, A-sheet, B-sheet and A-sheet, but even if he fourth sheet deck 1200*d* on which the A-sheets are stacked is far toward the upstream side from the second sheet deck 1200*b* on which the preceding B-sheets are stacked, design is made such that the succeeding A-sheets on the upstream side are pre-fed and therefore, the succeeding A-sheet can be conveyed with the predetermined interval kept relative to the preceding B-sheet until it is nipped between the registration rollers 137, whereby the image forming apparatus 1001 is enabled to form images on the sheets without showing down the speed of continuous printing.

(Description of the Pre-feeding Operation when Sheets are Supplied from Three Sheet Decks)

Figure 7:
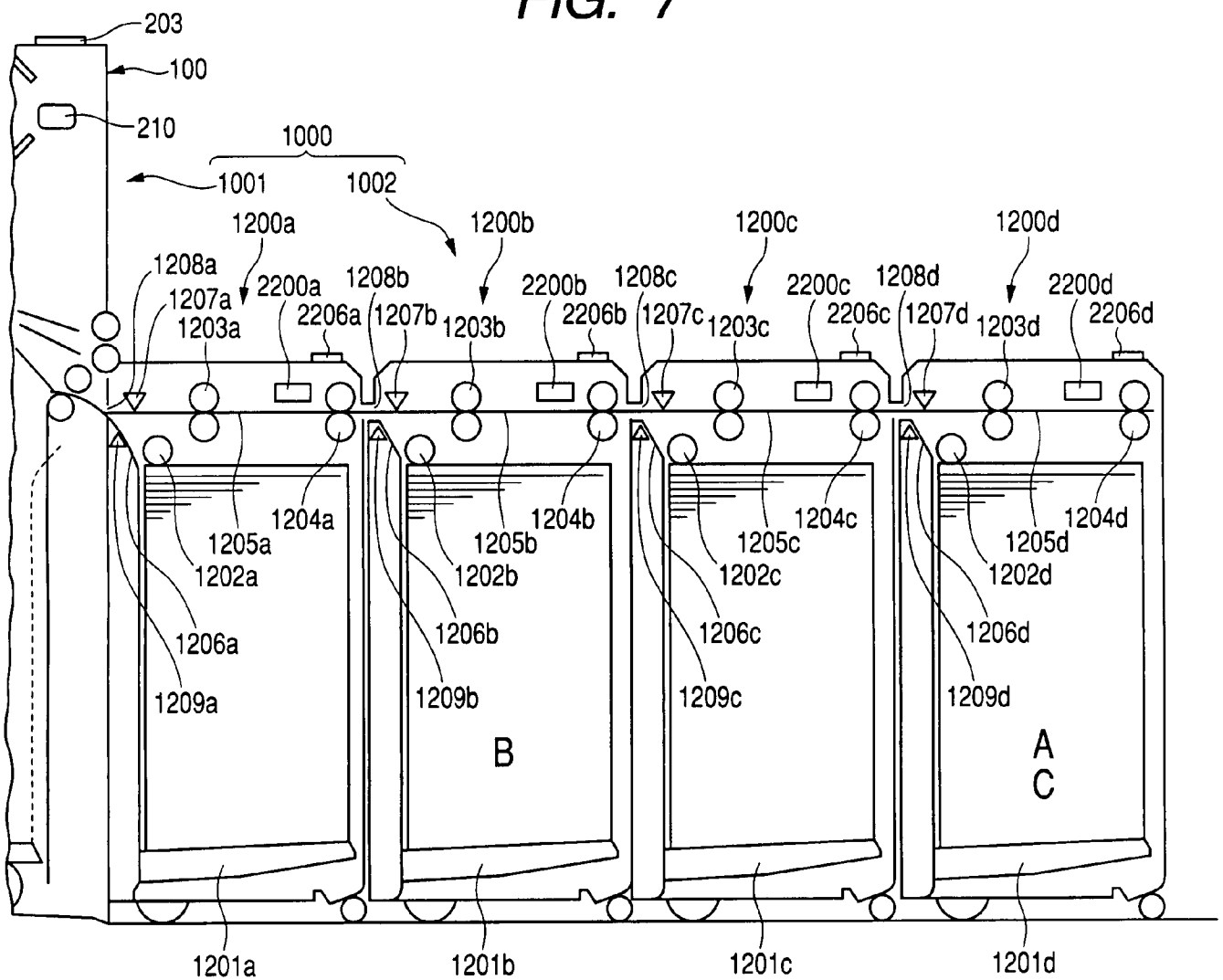
FIG. 7 is an enlarged view of a sheet supplying apparatus.
Figure 8:
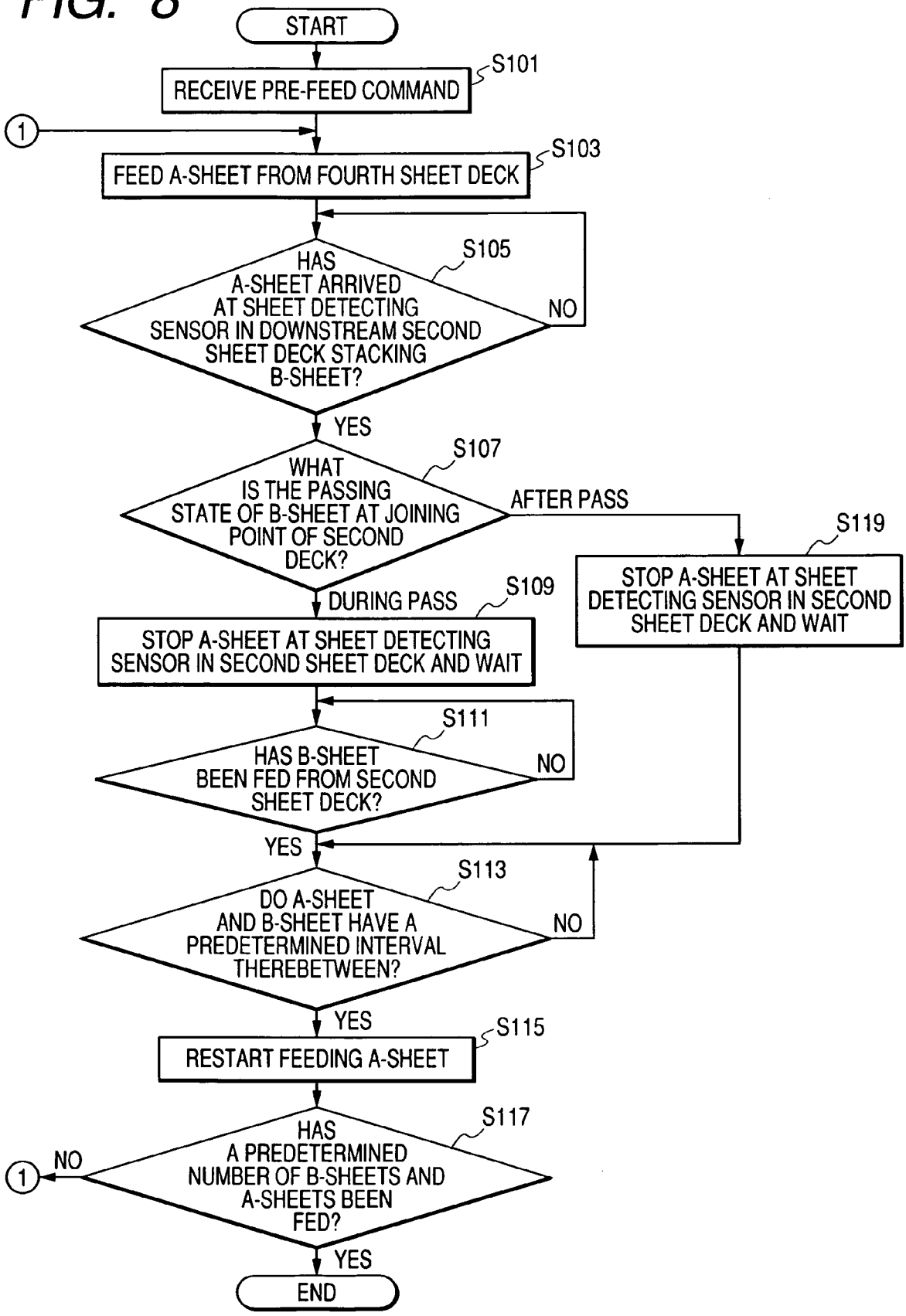
FIG. 8 is a flow chart illustrating the pre-conveying operation of the sheet supplying apparatus when sheets are supplied from two sheet decks.
Figure 9:
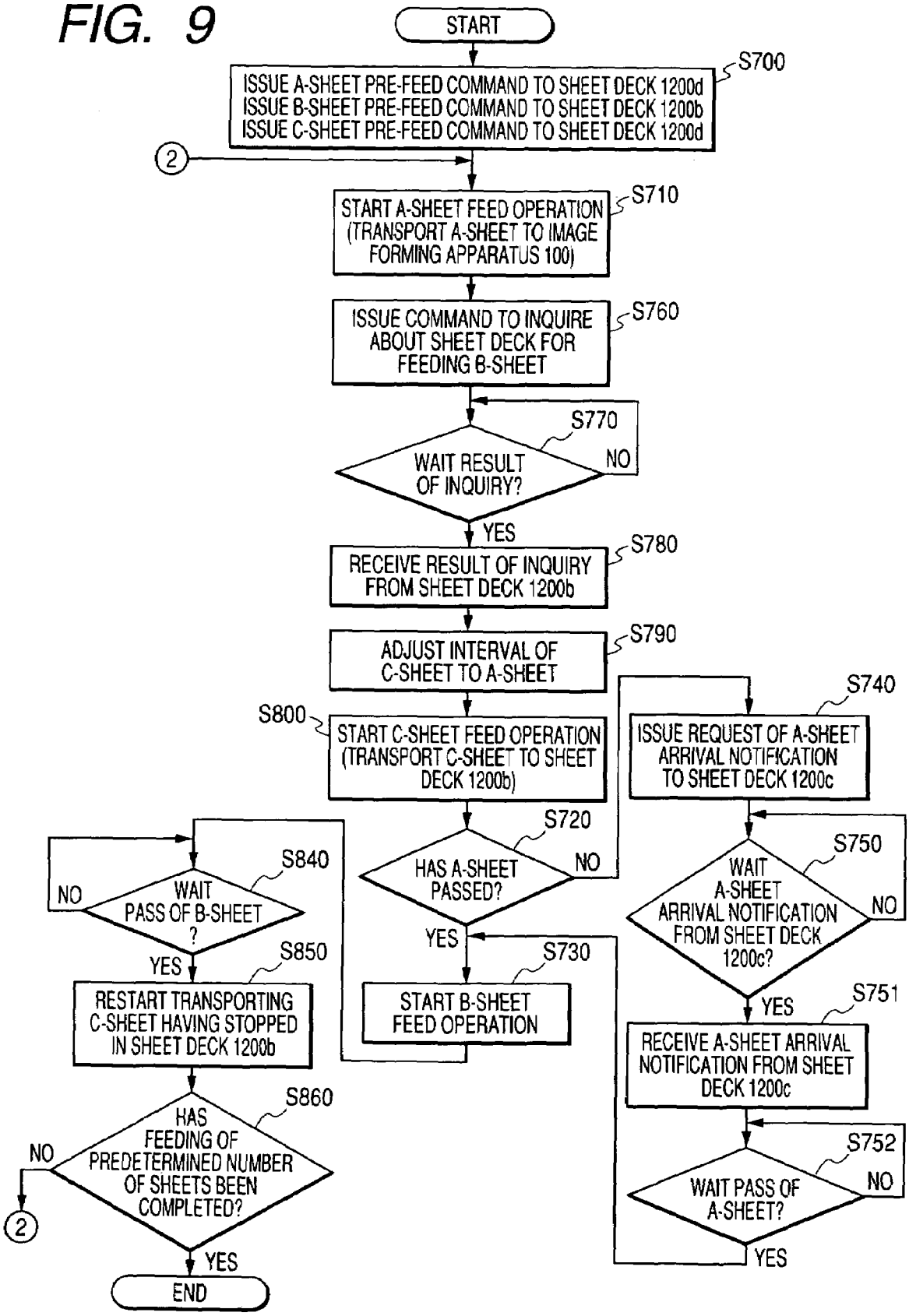
FIG. 9 is a flow chart illustrating the pre-conveying operation of the sheet supplying apparatus when sheets are supplied from three sheet decks.

Description will hereinafter be specifically made with reference to the front view of FIG. 7 showing the sheet decks and the flow chart of the pre-feeding operation shown in FIG. 9. It is to be understood that the sheet supplying order is such that as shown, for example, in the table of FIG. 10, the operation of first supplying A-sheet from the fourth sheet deck 1200*d* on the upstream side, and then supplying B-sheet from the second sheet deck 1200*b* on the downstream side, and again supplying C-sheet from the fourth sheet deck 1200*d* is repeated. That is, design is made such that a predetermined number of sheets are supplied by repeating the order of A-sheet, B-sheet, C-sheet, A-sheet, B-sheet, C-sheet, . . . . The fourth sheet deck 1200*d* is adapted to stack A-sheets and C-sheets thereon, but this is for making the description of the operation easily understood, and the C-sheets are the same as the A-sheets, and only the A-sheets are stacked on the fourth sheet deck 1200*d*. Thus, substantially, the sheets are supplied by repeating the order of A-sheet, B-sheet, A-sheet, B-sheet, A-sheet, . . . .

First, on the basis of the user's input information, in the page order shown in FIG. 10, an A-sheet and C-sheet pre-feed command is issued from the controlling portion 210 of the image forming apparatus main body 100 to the controlling portion 2200*d* of the fourth sheet deck 1200*d*, and a B-sheet pre-feed command is issued to the controlling portion 2200*b* of the second sheet deck 1200*b* (S700). At this time, the controlling portion 210 also issues a feed order command to the controlling portions 2200*d* and 2200*b* so as to feed the sheets by repeating the order of A-sheet, B-sheet, C-sheet.

The controlling portion 2200*d* of the fourth sheet deck 1200*d* which has received the A-sheet pre-feed command immediately starts the sheet supplying roller 1202*d* to thereby start the feeding of the A-sheet (S710). On the other hand, the controlling portion 2200*b* of the second sheet deck 1200*b*, when it receives the B-sheet pre-feed command, effects an inquiry as to flow which sheet deck the A-sheet which must be located before the B-sheet is supplied, and when it is judged to be from the fourth sheet deck 1200*d*, whether the A-sheet fed out from the fourth sheet deck 1200*d* has passed through the second sheet deck 1200*b* is judged (S720). The judgment is effected on the basis of the sheet detection by the sheet detecting sensor 1207*b* in the second sheet deck 1200*b*.

If the result of the judgement is "the A-sheet has already passed," the B-sheet feeding operation is started from the second sheet deck 1200*b* (S730). If conversely, the result of the judgment is "the A-sheet has not yet passed," the controlling portion 2200*b* of the second sheet deck 1200*b* transmits a command for issuing a request to notify of the arrival of the sheet to the controlling portion 2200*c* of the third sheet deck 1200*c* located upstream of the second sheet deck 1200*b* (S740). The second sheet deck 1200*b* stops the feeding-out of the sheet until the notification of the arrival of the A-sheet to the third sheet deck 1200*c* transmitted at S740 by the second sheet deck 1200*b* is sent thereto (the waiting process of the B-sheet is effected) (S750). When the second sheet deck 1200*b* receives the notification of the arrival of the A-sheet from the third sheet deck 1200*c* (S751) and the sheet detecting sensor 1207*b* detects the passage of the sheet and it is detected that the A-sheet has passed through the second sheet deck 1200*b* (S752), the second sheet deck 1200*b* starts the feeding of the B-sheet (S730). In this case, the B-sheet may be fed in advance to the vicinity of the joining point 1208*b*.

The processes of S760 to S800 which will be described next are carried out at the same time while the processes of the above-described S700, S740, S750, S751, S752 and S730 are carried out.

That is, the controlling portion 2200*d* of the fourth sheet deck 1200*d* which has received the C-sheet per-feed command inquires the controlling portions 2200*a*, 2200*b* and 2200*c* of the first sheet deck 1200*a*, the second sheet deck 1200*b* and the third sheet deck 1200*c*, respectively, to judge from which sheet deck located on the downstream side the B-sheet to be located before the C-sheet is supplied (S760). The controlling portion 2200*d* of the fourth sheet deck 1200*d* carries out the waiting process of the C-sheet until the result of the inquiry is returned from each sheet deck (S770).

When the result of the inquiry at S760 is returned from each sheet deck to the fourth sheet deck 1200*d* (S780), and when it is judged that the sheet deck for supplying the B-sheet is the second sheet deck 1200*b*, the controlling portion 2200*d* of the fourth sheet deck 1200*d* adjusts the interval of the C-sheet relative to the A-sheet (S790) and starts the control of feeding the C-sheet to a position at which it is detected by the sheet detecting sensor 1207*b* at the joining point 1208*b* of the second sheet deck 1200*b* (S800).

The C-sheet fed subsequently to the A-sheet, as previously described, is stopped at the position of the sheet detecting sensor 1207*b* in the second sheet deck 1200*b* and waits for the B-sheet to go out of the second sheet deck 1200*b* (S840). When it is detected by the sheet detecting sensor 1209*b* that the B-sheet has been fed out from the second sheet deck 1200*b*, the second sheet deck 1200*b* resumes the feeding of the C-sheet so far stopped (S850). Thus, the sheets have been supplied from the sheet decks 1200 to the image forming apparatus main body 100 in the order of A-sheet, B-sheet and C-sheet, and the above-described operation is repeated until a predetermined number of sheets are supplied to the image forming apparatus main body 100 (S860). There is also a case where after at S840, the B-sheet has been fed out from the second sheet deck 1200*b* as described at S107 and S119 above, the A-sheet arrives at the sheet detecting sensor 1209*b*, and is re-conveyed after a predetermined interval.

As described above, the sheet supplying apparatus 1002 of the present embodiment can effect the pre-feeding in which, even if the fourth sheet deck 1200*d* on which the C-sheets (substantially the same as the A-sheets) are stacked is for toward the upstream side from the second sheet deck 1200*b* on which the preceding B-sheets are stacked, when the A-sheet has been fed out from the fourth sheet deck 1200*d*, subsequently to the A-sheet, the C-sheet is also fed out from the fourth sheet deck 1200*d*, and the C-sheet is stopped at the position of the sheet detecting sensor 1207*b* of the second sheet deck 1200*b*, and is made to wait at that position until the B-sheet is fed out from the second sheet deck 1200*b*, and therefore enables the succeeding C-sheet to be conveyed at a predetermined interval relative to the preceding B-sheet until it is nipped between the registration rollers 137, and enables the image forming apparatus 100 to form images on the sheets without slowing down the speed of continuous printing.

(Description of the Pre-feeding Operation when Sheets are Supplied from Three Discrete Sheet Decks)

Description will now be made of a case where in contrast with the above-described embodiment, the supply order of sheets is such that first, the A-sheet is supplied from the third sheet deck 1200*c*, and then the B-sheet is supplied from the second sheet deck 1200*b* on the downstream side, and the C-sheet is supplied from the fourth sheet deck 1200*d*. A predetermined number of sheets are supplied by repeating the order of A-sheet, B-sheet, C-sheet, A-sheet, B-sheet, C-sheet, . . . . That is, description will be made of a case where in contrast with the above-described embodiment, the A-sheet, the B-sheet and the C-sheet are supplied from different sheet decks, respectively.

First, on the basis of the user's input information, in the page order of A-sheet, B-sheet and C-sheet, an A-sheet pre-feed command is issued from the controlling portion 210 of the image forming apparatus main body 100 to the controlling portion 2200*c* of the third sheet deck 1200*c*, a B-sheet pre-feed command is issued to the controlling portion 2200*b* of the second sheet deck 1200*b*, and a C-sheet pre-feed command is issued to the controlling portion 2200*d* of the fourth sheet deck 1200*d*. At this time, the controlling portion 210 also issues a feed order command to the controlling portions 2200*b* to 2200*d* so as to feed the sheets by repeating the order of A-sheet, B-sheet and C-sheet.

The controlling portion 2200*c* of the third sheet deck 1200*c* which has received the A-sheet pre-feed command immediately starts the sheet supplying roller 1202*c* to thereby start the feeding of the A-sheet. At the same time, the controlling portion 2200*b* of the second sheet deck 1200*b*, when it receives the B-sheet pre-feed command, effects an inquiry as to from which sheet deck the A-sheet which must be located before the B-sheet is supplied, and if it is judged to be from the third sheet deck 1200*c*, whether the A-sheet fed out from the third sheet deck 1200*c* has passed through the second sheet deck 1200*b* is judged. The judgment is effected on the basis of the sheet detection by the sheet detecting sensor 1207*b* in the second sheet deck 1200*b*.

If the result of the judgment is "the A-sheet has already passed," the B-sheet feeding operation is started from the second sheet deck 1200*b*. If conversely, the result of the judgment is "the A-sheet has not yet passed," the controlling portion 2200*b* of the second sheet deck 1200*b* starts the feeding of the B-sheet when the sheet detecting sensor 1207*b* detects the passage of the sheet and it is detected that the A-sheet has passed through the second sheet deck 1200*b*. In this case, the B-sheet may be fed in advance to the vicinity of the joining point 1208*b*.

At the same time, the controlling portion 2200*d* of the fourth sheet deck 1200*d* which has received the C-sheet pre-feed command inquires the controlling portions 2200*a*, 2200*b* and 2200*c* of the first sheet deck 1200*a*, the second sheet deck 1200*b* and the third sheet deck 1200*c*, respectively, to judge from which sheet deck located on the downstream side the A-sheet and the B-sheet to be located before the C-sheet join. The controlling portion 2200*d* of the fourth sheet deck 1200*d* carries out the C-sheet waiting process until the result of the inquiry is returned from each sheet deck.

When the result of the inquiry is returned from each sheet deck to the fourth sheet deck 1200*d*, the controlling portion 2200*d* of the fourth sheet deck 1200*d* recognizes that the sheet deck for supplying the A-sheet is the third sheet deck 1200*c* and that the sheet deck for supplying the B-sheet is the second sheet deck 1200*b*, and starts the control of conveying the C-sheet to a position at which it is detected by the sheet detecting sensor 1207*b* at the joining point 1208*c* of the third sheet deck 1200*c* which is the most downstream position which does not hinder the supply of the preceding sheet.

The C-sheet is stopped at the position of the sheet detecting sensor 1207*c* in the third sheet deck 1200*c* and waits for the A-sheet to go out form the third sheet deck 1200*c*. When it is detected by the sheet detecting sensor 1209*c* that the A-sheet has been fed out from the third sheet deck 1200*c*, the C-sheet is further fed to the position of the sheet detecting sensor 1207*b* in the second sheet deck 1200*b*. When as described above, the A-sheet passes through the second sheet deck 1200*b*, and the B-sheet is fed out from the second sheet deck 1200*b*, and it is detected by the sheet detecting sensor 1209*b* that this B-sheet has been fed out, the second sheet deck 1200*b* resumes the conveyance of the C-sheet so far stopped.

Thus the sheets are supplied form the sheet deck 1200 to the image forming apparatus main body 100 in the order of A-sheet, B-sheet and C-sheet, and the above-described operation is repeated until a predetermined number of sheets are supplied to the image forming apparatus main body 100.

As described above, it becomes possible for the sheet decks 1200*a* to 1200*d* to recognize the sheet deck on which the sheets to be fed earlier are stacked, and control so as to pre-feed the stacked sheets to this side of the joining point of that sheet deck, to thereby supply the sheets to the image forming apparatus main body 100 at a short inter-sheet interval even when a number of sheet decks are connected together, and the image forming apparatus 1001 is enabled to form images on the sheets without slowing down the speed of continuous printing.

While in the above-described embodiment, there has been shown an example in which the sheets are supplied in order from the three sheet decks, the present invention is not restricted thereto, but when in three or more sheet decks connected together, each sheet deck supplies sheets in order, it becomes possible for each sheet deck to judge the sheet deck stacking thereon sheets preceding its own sheets in order, and pre-feed its own sheets to the joining point of the sheets in that judges sheet deck to thereby shorten the distance to the preceding sheet, and the sheets can be supplied to the image forming apparatus with the inter-sheet interval shortened to thereby improve productivity.

While in the foregoing description, the position at which the pre-fed sheet waits is a position detected by the sheet detecting sensors 1207*a* to 1207*d*, the present invention is not restricted thereto. For example, the number of revolutions of the conveying rollers 1203*a* to 1203*c* or the conveying rollers 1204*a* to 1204*c*, or the number of revolutions of a motor for rotating those rollers may be detected by an encoder or a pulse counter. As described above, as the sheet detecting means of the present invention, design may be made such that the position of the sheet is detected by the number of revolutions of the rollers or the motor.

Also, when the sheet decks are to be connected in series to the image forming apparatus main body 100, if the sheet decks are connected to the image forming apparatus main body 100 in the order from the sheet deck which feeds out the sheets more frequently, it will never happen that the other sheet decks are operated unnecessarily, and the sheet decks can be used for a long period.

This application claims priority from Japanese Patent Application No. 2003-356361 filed on Oct. 16, 2003, which is hereby incorporated by reference herein.

What is claimed is:

1. A sheet supplying apparatus comprising:

three or more sheet decks being connected in series, each of said three or more sheet decks having sheet stacking means for supporting the sheets thereon, sheet supplying means for supplying the sheets on said sheet stacking means, a sheet conveying path, which guides the sheets from a sheet deck disposed upstream to a sheet deck disposed downstream in a sheet feeding direction, sheet conveying means for conveying the sheets along said sheet conveying path, and a joining conveying path joining said sheet conveying path for guiding the sheets from said sheet stacking means to said sheet conveying path, wherein respective sheet conveying paths of said three or more sheet decks are connected in series; and controlling means for controlling a sheet feeding operation of said three or more sheet decks, wherein said controlling means judges a position of a sheet deck, which supplies a preceding sheet prior to a sheet supplied in predetermined order when the sheets are supplied in order from each sheet deck, wherein when the position of the judged sheet deck is disposed downstream of a sheet deck, which supplies the sheet in the predetermined order, said controlling means controls so as to pre-feed the sheet upstream of a joining point of said sheet conveying path and said joining conveying path in the sheet deck of said preceding sheet, and when the position of the judged sheet deck is disposed upstream of a sheet deck, which supplies the sheet in the predetermined order, said controlling means controls so as not to pre-feed the sheet.

2. A sheet supplying apparatus according to claim 1, wherein each of said three or more sheet decks comprises a sheet detecting sensor, which is disposed upstream of the joining point and detects the sheets conveyed on said sheet conveying path, and said controlling means operatively controls said sheet conveying means of each sheet deck to thereby pre-feed the sheet on a basis of detection by said sheet detecting sensor of said judged sheet deck, and make the sheet in the predetermined order wait until an interval between said preceding sheet and the sheet in the predetermined order becomes a predetermined interval.

3. A sheet supplying apparatus according to claim 1, wherein said controlling means effects the pre-feeding of the sheet during a time until the sheet is supplied from said sheet deck downstream.

4. A sheet supplying apparatus according to claim 1, wherein said controlling means is provided with a main controlling portion for selecting a sheet deck on which the sheets are stacked, and designating an operation order of said sheet deck, and a sub-controlling portion provided in each of said sheet decks for operatively controlling the sheet deck when selected by said main controlling portion.

5. A sheet supplying apparatus according to claim 1, wherein a number of said sheet decks connected in series can be increased or decreased.

6. A sheet supplying apparatus according to claim 1, wherein an arrangement order of said sheet decks connected in series is changeable.

7. A sheet supplying apparatus according to claim 1, wherein at least one of said plurality of sheet decks can supply sheets differing in kind from sheets in other sheet decks.

8. A sheet supplying apparatus according to claim 1, wherein when the judged sheet deck is disposed upstream of the sheet deck for supplying the sheet in the predetermined order, said controlling means controls so as to feed the sheet upstream of a joining point of said sheet conveying path in the sheet deck for supplying the sheet in the predetermined order and said joining conveying path thereof.

9. An image forming system comprising:

an image forming apparatus for forming an image on a sheet;

a sheet supplying apparatus having three or more sheet decks being connected in series; and wherein each of said three or more sheet decks has sheet stacking means for supporting the sheets thereon, sheet supplying means for supplying the sheets on said sheet stacking means, a sheet conveying path, which guides the sheets from a sheet deck disposed upstream to a sheet deck disposed downstream in a sheet feeding direction, sheet conveying means for conveying the sheets along said sheet conveying path, and a joining conveying path joining said sheet conveying path for guiding the sheets from said sheet stacking means to said sheet conveying path, wherein respective sheet conveying paths of said three or more sheet decks are connected in series; and controlling means for controlling a sheet feeding operation of said three or more sheet decks, wherein said controlling means judges a position of a sheet deck, which supplies a preceding sheet prior to a sheet supplied in predetermined order when the sheets are supplied in order from each sheet deck, wherein when the position of the judged sheet deck is disposed downstream of a sheet deck, which supplies the sheet in the predetermined order, said controlling means controls so as to pre-feed the sheet upstream of a joining point of said sheet conveying path and said joining conveying path in the sheet deck of said preceding sheet, and when the position of the judged sheet deck is disposed upstream of a sheet deck, which supplies the sheet in the predetermined order, said controlling means controls so as to pre-feed the sheet.

10. An image forming system according to claim 9, wherein said sheet supplying apparatus and said image forming apparatus are detachably connected together.

11. An image forming system according to claim 9, wherein a discharged sheet treating apparatus for jogging and binding the sheets discharged from said image forming apparatus is connectable to said image forming apparatus.

12. An image forming system according to claim 9 or 10, wherein a number of said sheet decks connected in series can be increased or decreased.

13. An image forming system according to claim 9 or 10, wherein an arrangement order of said sheet decks connected in series is changeable.

14. An image forming system according to claim 9 or 10, wherein at least one of said plurality of sheet decks can supply sheets differing in kind from sheets in other sheet decks.

* * * * *

UNITED STATES PATENT AND TRADEMARK OFFICE

CERTIFICATE OF CORRECTION

PATENT NO. : 7,380,780 B2
APPLICATION NO. : 10/960091
DATED : June 3, 2008
INVENTOR(S) : Sasaki et al.

It is certified that error appears in the above-identified patent and that said Letters Patent is hereby corrected as shown below:

COLUMN 3:
Line 27, “are” should read --is--.

COLUMN 5:
Line 30, “arrow” should read --an arrow--.
Line 47, “is” should read --that is--.

COLUMN 7:
Line 17, “the description” should read --The description--.

COLUMN 8:
Line 17, “a” should read --an--.

COLUMN 10:
Line 33, “to from” should read --to form--.

COLUMN 13:
Line 20, “2200a to 2200a” should read --2200a to 2200d--.
Line 24, “he” should read --the--.
Line 29, “provided” should read --provided in--.
Line 46, “kind” should read --kind of--.

COLUMN 15:
Line 61, “other” should read --another--.

COLUMN 16:
Line 1, “he” should read --the--.
Line 10, “showing” should read --slowing--.
Line 51, “flow which sheet deck” should read --show which sheet deck of--.
Line 52, “which” should be deleted.

COLUMN 17:
Line 23, “side” should read --side of--.

COLUMN 19:
Line 14, “form” should read --from--.
Line 25, “sheets are supplied form” should read --sheets that are supplied from--.

UNITED STATES PATENT AND TRADEMARK OFFICE

CERTIFICATE OF CORRECTION

PATENT NO. : 7,380,780 B2
APPLICATION NO. : 10/960091
DATED : June 3, 2008
INVENTOR(S) : Sasaki et al.

It is certified that error appears in the above-identified patent and that said Letters Patent is hereby corrected as shown below:

COLUMN 21:
Line 19, "and" should be deleted.

Signed and Sealed this

Seventeenth Day of February, 2009

JOHN DOLL
*Acting Director of the United States Patent and Trademark Office*